US009405259B2

(12) United States Patent
Kitamoto

(10) Patent No.: US 9,405,259 B2
(45) Date of Patent: Aug. 2, 2016

(54) IMAGE FORMING APPARATUS HAVING FUNCTION OF PRINTING ON INDEX SHEET, IMAGE FORMING SYSTEM, AND NON-TRANSITORY COMPUTER-READABLE RECORDING MEDIUM

(71) Applicant: Kyocera Document Solutions Inc., Osaka (JP)

(72) Inventor: Daijiro Kitamoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/495,105

(22) Filed: Sep. 24, 2014

(65) Prior Publication Data

US 2015/0093126 A1 Apr. 2, 2015

(30) Foreign Application Priority Data

Sep. 30, 2013 (JP) ..... 2013-204469
Jun. 30, 2014 (JP) ..... 2014-134623

(51) Int. Cl.
*G03G 15/00* (2006.01)

(52) U.S. Cl.
CPC ..... *G03G 15/70* (2013.01); *G03G 15/502* (2013.01); *G03G 15/5016* (2013.01); *G03G 15/6588* (2013.01); *G03G 2215/00523* (2013.01)

(58) Field of Classification Search
CPC ..... G03G 17/70; G03G 15/70
USPC ..... 399/21
See application file for complete search history.

(56) References Cited

U.S. PATENT DOCUMENTS 6,141,507 A * 10/2000 Sawada ..... H04N 1/00002 399/10
7,881,622 B2 * 2/2011 Sayama ..... G03G 15/70 399/16
8,676,065 B2 * 3/2014 Park ..... G03G 15/70 271/258.01
2004/0201867 A1 * 10/2004 Katano ..... G06F 8/65 358/1.15
2004/0263869 A1 * 12/2004 Kimura ..... G06F 3/1205 358/1.1
2005/0105923 A1 * 5/2005 Utsunomiya ..... G03G 15/70 399/21
2005/0201765 A1 * 9/2005 Shinga ..... B65H 1/266 399/16
2008/0063414 A1 * 3/2008 Motoyama ..... G03G 15/55 399/18
2009/0072468 A1 * 3/2009 Ueda ..... G03G 15/6502 271/9.05
2010/0276870 A1 * 11/2010 Yamada ..... B41J 3/60 271/225

FOREIGN PATENT DOCUMENTS

JP 2005-289567 10/2005

* cited by examiner

*Primary Examiner* — Anthony Nguyen
(74) *Attorney, Agent, or Firm* — K&L Gates LLP

(57) ABSTRACT

An image forming apparatus includes a printing processing unit, a paper jam detection unit, and an operation display unit. The printing processing unit performs printing on a plurality of index sheets having index labels in different positions. The paper jam detection unit detects a paper jam in the plurality of index sheets. The operation display unit displays, when the paper jam is detected, a paper jam handling pattern selection screen for selecting a paper jam handling pattern of the printing processing unit.

13 Claims, 8 Drawing Sheets

IMAGE FORMING APPARATUS HAVING FUNCTION OF PRINTING ON INDEX SHEET, IMAGE FORMING SYSTEM, AND NON-TRANSITORY COMPUTER-READABLE RECORDING MEDIUM

REFERENCE TO RELATED APPLICATIONS

This application relates to and claims priority from Japanese Patent Application No. 2013-204469, filed in the Japan Patent Office on Sep. 30, 2013, and Japanese Priority Patent Application No. 2014-134623 based on Japanese Patent Application No. 2013-204469, filed in the Japan Patent Office on Jun. 30, 2014, the entire disclosures of which are incorporated herein by reference.

FIELD

Unless otherwise indicated herein, the description in this field section or the background section is not prior art to the claims in this application and is not admitted to be prior art by inclusion in this section. The present disclosure relates to an image forming apparatus that can print on a sheet of paper including an index label (hereinafter referred to as "index sheet"), an image forming system, and a non-transitory computer-readable recording medium.

BACKGROUND

A typical image forming apparatus such as a printer and a multifunction peripheral (MFP) is configured to automatically print, when a paper jam is removed, an image that has failed to be printed on a subsequently-fed sheet of paper (automatic jam recovery function). Therefore, when a paper jam occurs during printing of a plurality of index sheets having index labels in different positions and then an index sheet that has caused the paper jam is removed, an image to be printed on the index sheet that has caused the paper jam is automatically printed on a subsequently-fed index sheet. However, the position of the index label on the subsequently-fed index sheet is different from the position of the index label on the index sheet that has caused the paper jam. In addition, when an image is printed also on the index label, the image is printed only on a fixed size part of the index sheet without being printed on the index label, which makes printing wasteful.

Therefore, for example, there is known an image forming apparatus in which, when a specific sheet of paper such as an index sheet exists inside the image forming apparatus at the occurrence of a conveying failure, an alternative sheet of paper different from the specific sheet of paper is fed at a timing to feed the specific sheet of paper in a later jam recovery process. Further, a message image indicating that a sheet of paper different from a proper sheet of paper has been fed due to the occurrence of the conveying failure is recorded on the alternative paper sheet and delivered, which allows a user to recognize necessity of recovery work.

In the known image forming apparatus, the user is allowed to recognize the necessity of recovery work, but in order to perform the printing for the index sheet that has caused the paper jam, it is necessary to set information on the index sheet, the index label, and the like again before the printing.

SUMMARY

The present disclosure relates to an image forming apparatus that prevents wasteful printing due to deviation in sheet feeding when a paper jam occurs in printing on a plurality of index sheets having index labels in different positions and allow a user to select a pattern of handling the paper jam. The present disclosure also relates to an image forming system, and a non-transitory computer-readable recording medium including a printer driver.

In one embodiment, an image forming apparatus includes a printing processing unit, a paper jam detection unit, and an operation display unit. The printing processing unit performs printing on a plurality of index sheets having index labels in different positions. The paper jam detection unit detects a paper jam in the plurality of index sheets. The operation display unit displays, when the paper jam is detected, a paper jam handling pattern selection screen for selecting a paper jam handling pattern of the printing processing unit.

In another embodiment, an image forming system includes an image forming apparatus and a client apparatus which are connected to a network. The image forming apparatus includes a printing processing unit and a paper jam detection unit. The printing processing unit performs printing on a plurality of index sheets having index labels in different positions. The paper jam detection unit detects a paper jam in the plurality of index sheets. The client apparatus includes an operation display unit. The operation display unit displays, when the paper jam is detected, a paper jam handling pattern selection screen for selecting a paper jam handling pattern of the printing processing unit.

In yet another embodiment, a non-transitory computer-readable recording medium includes a printer driver. The printer driver causes a computer of a client apparatus to function as a print instruction unit and a printing processing unit. The print instruction unit instructs an image forming apparatus connected to the client apparatus via a network to perform printing. The image forming apparatus includes a printing processing unit that performs the printing on a plurality of index sheets having index labels in different positions, and a paper jam detection unit that detects a paper jam in the plurality of index sheets. The screen display unit displays a paper jam handling pattern selection screen for selecting a paper jam handling pattern of the printing processing unit, on an operation display unit of the client apparatus.

Additional features and advantages are described herein, and will be apparent from the following detailed description and the figures.

BRIEF DESCRIPTION OF THE DRAWINGS

All drawings are intended to illustrate some aspects and examples of the present disclosure. The drawings described are only schematic and are non-limiting, and are not necessarily drawn to scale.

DETAILED DESCRIPTION

Various embodiments are described below with reference to the figures. It should be understood, however, that numerous variations from the depicted arrangements and functions are possible while remaining in the scope and spirit of the claims. For instance, one or more elements may be added, removed, combined, distributed, substituted, re-positioned, re-ordered, and/or otherwise changed. Further, where this description refers to one or more functions being implemented on and/or by one or more devices, one or more machines, and/or one or more networks, it should be understood that one or more of such entities could carry out one or more of such functions by themselves or in cooperation, and may do so by application of any suitable combination of hardware, firmware, and/or software. For instance, one or more processors may execute one or more sets of programming instructions as at least part of carrying out one or more of the functions described herein.

Figure 1:
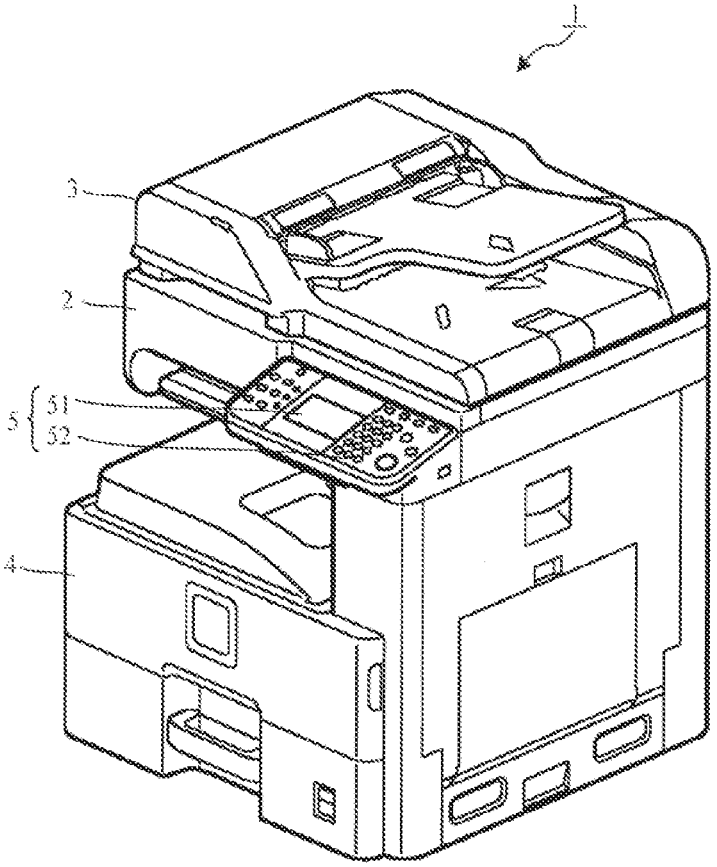
FIG. 1 is a schematic diagram illustrating an external configuration of an image forming apparatus according to an embodiment of the present disclosure.

FIG. 1 is a schematic diagram illustrating an external configuration of an image forming apparatus 1 according to an embodiment of the present disclosure. The image forming apparatus 1 is a printer, a multifunction peripheral (MFP), or the like, and includes a manuscript reading unit 2, a manuscript feeding unit 3, a main body unit 4, and an operation unit 5. The manuscript reading unit 2 is located as a unit above the main body unit 4, and the manuscript feeding unit 3 is located as a unit above the manuscript reading unit 2.

The operation unit 5 that performs settings of the image forming apparatus 1 and an operational instruction is located on a front side of the image forming apparatus 1. The operation unit 5 includes a liquid crystal display unit 51 and an operation button 52. A user operates the operation unit 5 to input an instruction, to thereby perform various settings of the image forming apparatus 1 and execute various functions such as image formation. The liquid crystal display unit 51 is configured to indicate the status of the image forming apparatus 1, display an image formation situation and a print unit count, and as a touch panel, perform functions such as double-sided printing and black-and-white inversion and various settings such as a magnification setting and a density setting. As the operation button 52, there are provided a start button that starts the image formation, a stop/clear button that cancels the image formation, a reset button used to initialize the various settings of the image forming apparatus 1 to default states, a numeric keypad, and the like.

Figure 2:
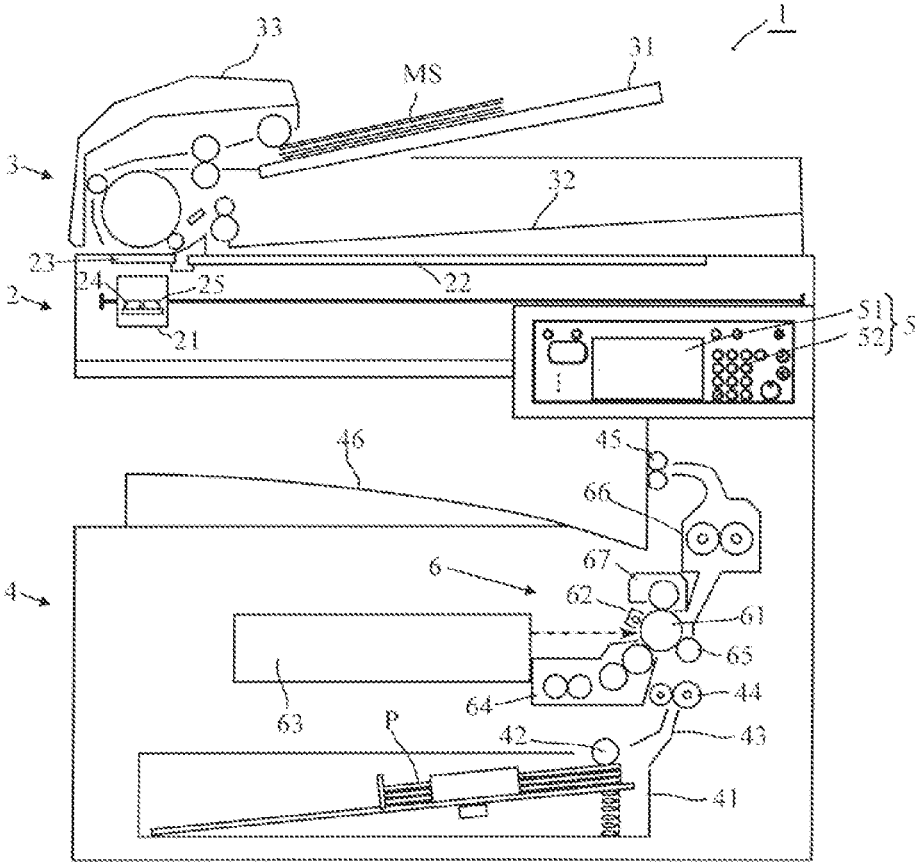
FIG. 2 is a schematic diagram illustrating an internal configuration of the image forming apparatus.

FIG. 2 is a schematic diagram illustrating an internal configuration of the image forming apparatus 1. The manuscript reading unit 2 includes a scanner 21, a platen glass plate 22, and a manuscript reading slit 23. The scanner 21 includes a light source 24 using a light emitting diode (LED) and a light receiving unit 25 formed of a charge coupled device (CCD) line sensor, a complementary metal oxide semiconductor (CMOS) line sensor, and the like, and is configured to move in a direction in which a manuscript MS is conveyed by the manuscript feeding unit 3. The manuscript reading slit 23 is a slit formed in a direction orthogonal to the direction in which the manuscript MS is conveyed by the manuscript feeding unit 3.

The manuscript feeding unit 3 includes a manuscript placement unit 31, a manuscript delivery unit 32, and a manuscript conveying mechanism 33. The manuscripts MS set on the manuscript placement unit 31 are successively drawn out by the manuscript conveying mechanism 33 one sheet at a time to be fed to a position opposite the manuscript reading slit 23 and then delivered onto the manuscript delivery unit 32. Further, the manuscript feeding unit 3 and the manuscript reading unit 2 are joined to each other by a hinge mechanism on a rear side of the image forming apparatus 1, and the manuscript feeding unit 3 functions as a platen cover that opens/closes an upper surface of the platen glass plate 22. By opening the manuscript feeding unit 3 upward, the upper surface of the platen glass plate 22 is opened to allow the manuscript MS to be set on the platen glass plate 22.

When reading of the manuscript MS is instructed by the operation button 52 of the operation unit 5 in a state in which the manuscript MS is not set on the manuscript placement unit 31 or in an open state in which the manuscript feeding unit 3 (platen cover) is opened, the manuscript MS set on the platen glass plate 22 is read. To read the manuscript MS placed on the platen glass plate 22, the scanner 21 is moved to a position opposite the platen glass plate 22, reads the manuscript MS set on the platen glass plate 22 while scanning in a sub-scanning direction orthogonal to a main-scanning direction from a sub-scanning direction reference line B to acquire image data, and outputs the acquired image data to a control unit 7 illustrated in FIG. 3 included inside the main body unit 4.

When reading of the manuscript MS is instructed by the operation button 52 of the operation unit 5 in a state in which the manuscript MS is set on the manuscript placement unit 31, the manuscript MS fed by the manuscript feeding unit 3 is read. The manuscript MS is set on the manuscript placement unit 31 with its front surface (surface on which a manuscript image is read) facing up. Then, the manuscript MS set on the manuscript placement unit 31 is fed from a left side by the manuscript feeding unit 3, and the front surface of the manuscript MS is guided to a position opposite the manuscript reading slit 23. Further, to read the manuscript MS fed by the manuscript feeding unit 3, the scanner 21 is moved to a position opposite the manuscript reading slit 23, reads the manuscript MS via the manuscript reading slit 23 in synchronization with a conveying operation performed by the manuscript feeding unit 3 to acquire image data, and outputs the acquired image data to the control unit 7 illustrated in FIG. 3 included inside the main body unit 4.

The main body unit 4 includes a recording unit 6, a sheet feeding unit 41, a sheet feeding roller 42, a sheet conveying path 43, registration rollers 44, and delivery rollers 45. The sheet feeding unit 41 is a sheet feeding cassette in which a plurality of index sheets P are received, and the sheet feeding roller 42 draws out the index sheets P from the sheet feeding unit 41 one sheet at a time to the sheet conveying path 43. The index sheet P drawn out to the sheet conveying path 43 by the sheet feeding roller 42 is fed to the recording unit 6 by the registration rollers 44. The registration rollers 44 feed the index sheet P so as to align a leading edge of the index sheet P supplied from the sheet feeding cassette with a leading edge of an image read from a manuscript. Then, the index sheet P subjected to the recording by the recording unit 6 is delivered by the delivery rollers 45 to a delivery space 46 formed between the manuscript reading unit 2 and the main body unit 4. In this manner, the sheet feeding roller 42, the registration rollers 44, and the delivery rollers 45 function as a conveyance unit for the index sheet P.

The recording unit 6 includes a photoconductor drum 61, a charging unit 62, an exposure unit 63, an image forming unit 64, a transfer unit 65, a fixing unit 66, and a cleaning unit 67.

The exposure unit 63 is an optical unit including a laser apparatus, a minor, and the like, and outputs and exposes a laser beam based on the image data to the photosensitive drum 61 that has been uniformly charged by the charging unit 62, to thereby form an electrostatic latent image on a surface of the photoconductor drum 61. The image forming unit 64 is a developing unit that develops the electrostatic latent image formed on the photosensitive drum 61 by using toner, and forms a toner image based on the electrostatic latent image on the photoconductor drum 61. The transfer unit 65 transfers the toner image formed on the photoconductor drum 61 by the image forming unit 64 onto the index sheet P. The fixing unit 66 heats the index sheet P onto which the toner image has been transferred by the transfer unit 65, to thereby fix the toner image onto the index sheet P. Then, toner remaining on the photoconductor drum 61 is removed by the cleaning unit 67.

Figure 3:
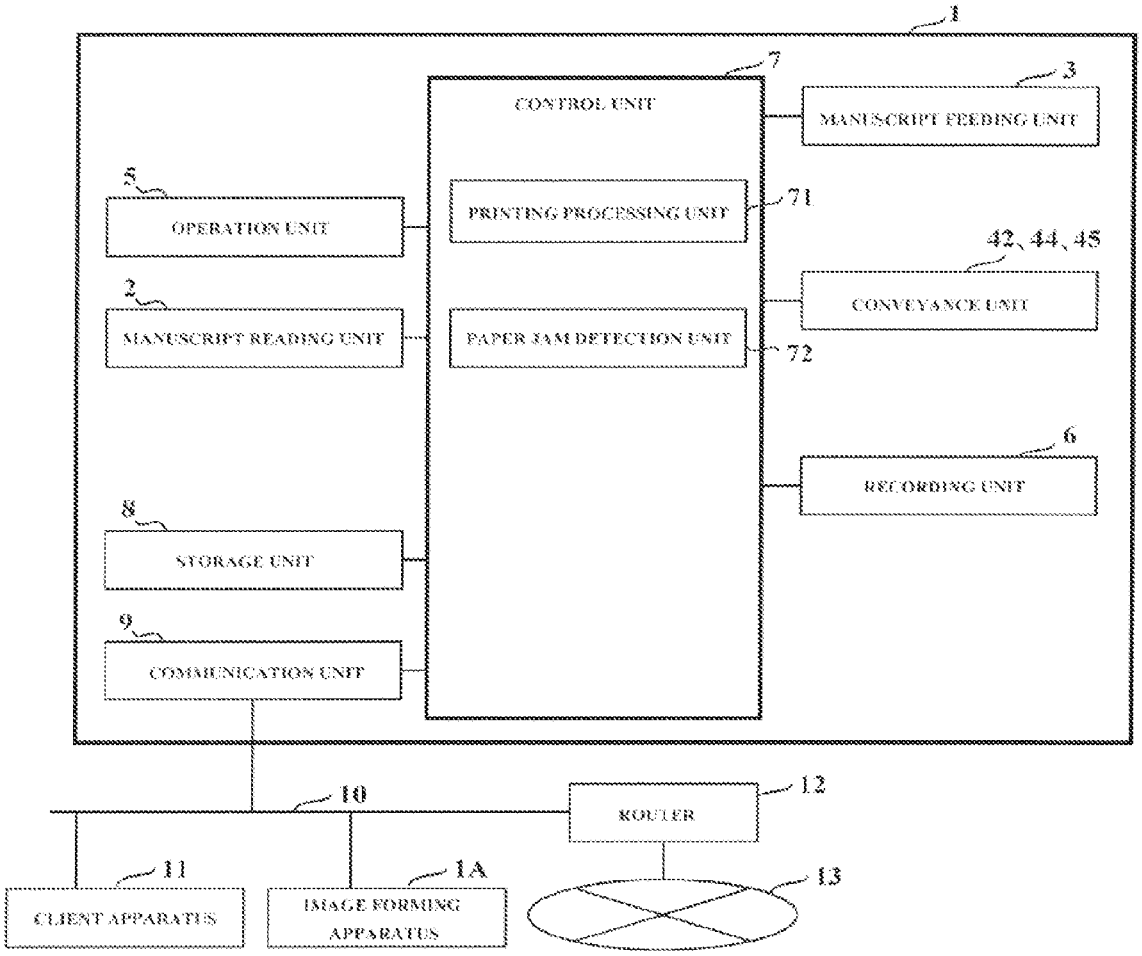
FIG. 3 is a schematic diagram illustrating a functional block configuration of the image forming apparatus.

FIG. 3 is a schematic diagram illustrating a functional block configuration of the image forming apparatus 1. The manuscript reading unit 2, the manuscript feeding unit 3, the conveyance unit (sheet feeding roller 42, registration rollers 44, and delivery rollers 45), the operation unit 5, the recording unit 6, a storage unit 8, and a communication unit 9 are connected to the control unit 7, and are subjected to operational control by the control unit 7. The control unit 7 includes a printing processing unit 71 and a paper jam detection unit 72.

The control unit 7 is an information processing unit such as a microcomputer including a read only memory (ROM) and a random access memory (RAM). A control program for performing the operational control of the image forming apparatus 1 is stored in the ROM. The control unit 7 reads the control program stored in the ROM, and expands the control program onto the RAM, to thereby control an entire apparatus in accordance with predetermined instruction information input via the operation unit 5. The printing processing unit 71 executes a printing operation in accordance with an instruction issued from the control unit 7. When a paper jam occurs in the conveyance unit (sheet feeding roller 42, registration rollers 44, and delivery rollers 45), the paper jam detection unit 72 detects the paper jam and notifies the printing processing unit 71 of the occurrence of a paper jam.

The storage unit 8 is a storage means such as a semiconductor memory or a hard disk drive (HDD), and stores the image data on the manuscript MS read by the scanner 21 along with various kinds of management information and setting information.

The communication unit 9 has the function of transmitting/receiving various kinds of data to/from a client apparatus 11 such as a personal computer (PC) and another image forming apparatus 1*a* via a network 10 such as a LAN. Further, the communication unit 9 is configured to be connected to the Internet 13 via the network 10 and a router 12. The communication unit 9 functions to transmit/receive various kinds of data to/from various kinds of communication equipment connected to the Internet 13.

FIG. 4A, FIG. 4B, FIG. 4C, and FIG. 4D are diagrams illustrating a paper jam handling pattern selection screen and examples of display screens corresponding to respective paper jam handling patterns according to an embodiment.

First, the user causes an index sheet setting screen (not illustrated) to be displayed on the touch panel of the liquid crystal display unit 51, and sets index sheet information including an index label count, a print size, an index label interval, and an index label size. The set index sheet information is stored in the storage unit 8. Further, when an image is printed on an index label, the user causes an index label setting screen (not illustrated) to be displayed on the touch panel of the liquid crystal display unit 51, and sets index label information including the image to be printed on the index label, the format of a character when the image includes the character, and the layout thereof. The set index label information is stored in the storage unit 8. The user causes a paper jam handling pattern selection screen 80 illustrated in FIG. 4A to be displayed, and sets an "OK" (confirmation) button 80*a* after selecting one of paper jam handling pattern Nos. "1", "2", and "3". The selected handling pattern No. is stored in the storage unit 8. Subsequently, when the user sets the manuscript MS on the manuscript placement unit 31, while setting the index sheet P in the sheet feeding unit 41, and operates the operation button 52 to start printing on an index sheet, the printing processing unit 71 starts the printing process.

Figure 5:
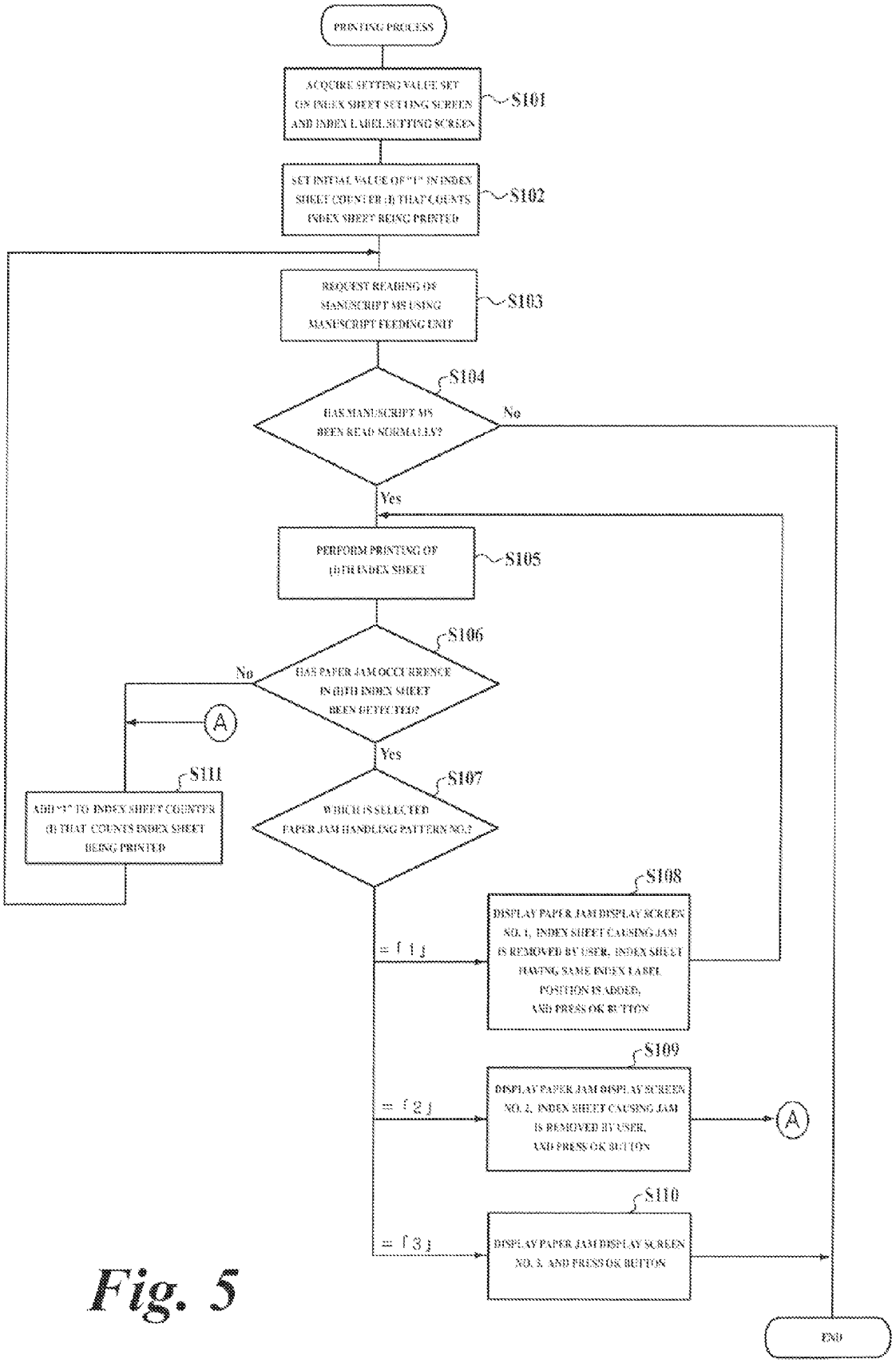
FIG. 5 is a flowchart of printing process for an index sheet according to an embodiment.

FIG. 5 is a flowchart of printing process for an index sheet according to an embodiment.

In Step S101, the printing processing unit 71 acquires setting values set on the index sheet setting screen and the index label setting screen and stored in the storage unit 8, and uses the setting values set on the index sheet setting screen and the index label setting screen to set a toner fixing size in the fixing unit 66, a paper sheet interval in the sheet feeding roller 42, and the like.

In Step S102, the printing processing unit 71 sets an initial value of "1" in an index sheet counter (I) that counts index sheet being printed.

In Step S103, the printing processing unit 71 requests the reading of the manuscript MS using the manuscript feeding unit 3.

In Step S104, the printing processing unit 71 determines whether or not the manuscript MS has been normally read. When the manuscript MS has been normally read (Yes in Step S104), the procedure advances to Step S105. When the manuscript MS has not been normally read (No in Step S104), the manuscript MS is not set on the manuscript placement unit 31, and hence the printing process is brought to an end.

In Step S105, in a case of Yes in Step S104, the printing processing unit 71 extracts the (I)th index sheet P from the sheet feeding unit 41, and performs printing of the (I)th index sheet.

In Step S106, the printing processing unit 71 determines whether or not the paper jam occurrence in the (I)th index sheet P has been detected by the paper jam detection unit 72. When a paper jam has occurred in the (I)th index sheet P (Yes in Step S106), the procedure advances to Step S107. When a paper jam has not occurred in the (I)th index sheet P (No in Step S106), the procedure advances to Step S111.

In Step S107, in a case of Yes in Step S106, the printing processing unit 71 acquires the paper jam handling pattern No. from the storage unit 8. The printing processing unit 71 advances to Step S108 when the paper jam handling pattern No. is "1", advances to Step S109 when the paper jam handling pattern No. is "2", and advances to Step S110 when the paper jam handling pattern No. is "3".

Figure 4A:
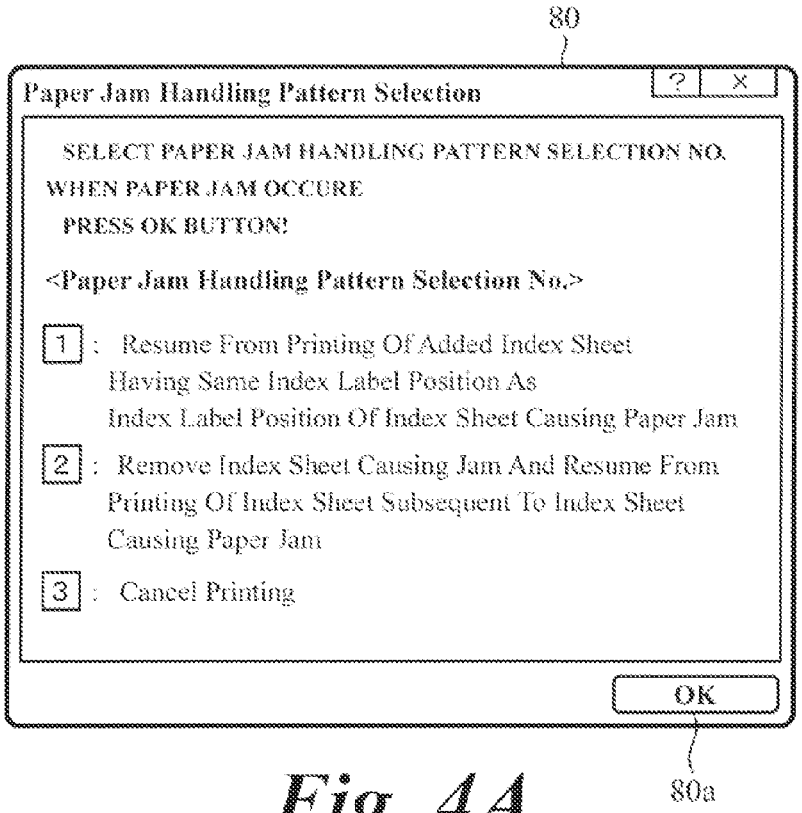
FIG. 4A, FIG. 4B, FIG. 4C, and FIG. 4D are schematic diagrams illustrating a paper jam handling pattern selection screen and examples of display screens corresponding to respective paper jam handling patterns according to an embodiment.
Figure 4B:
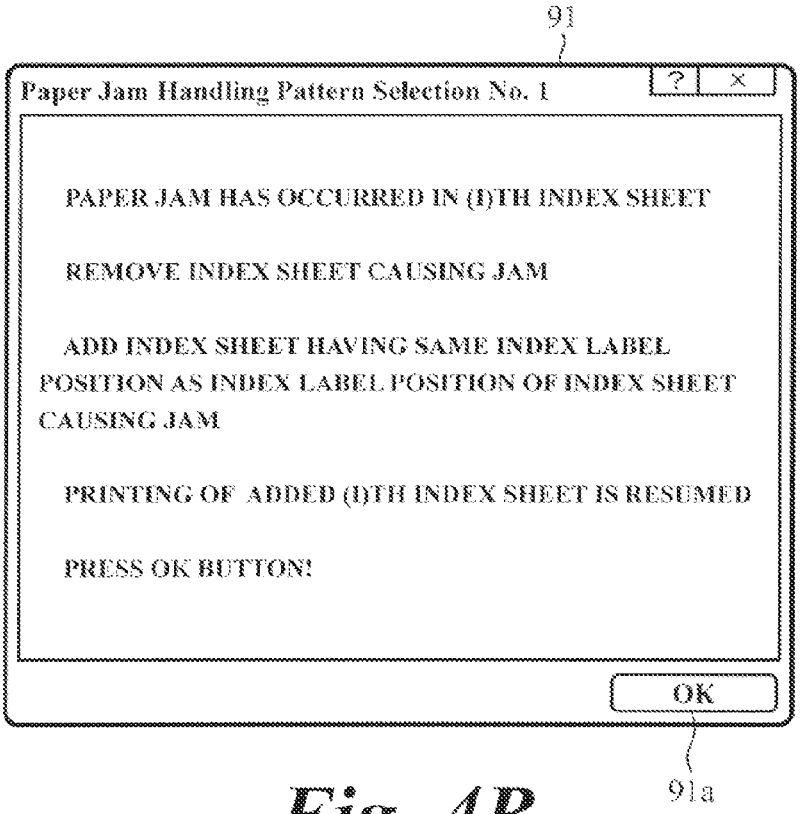

In Step S108, when the paper jam handling pattern No. is "1", the printing processing unit 71 displays a paper jam display screen 91 illustrated in FIG. 4B on the liquid crystal display unit 51, and stands by until the index sheet that has caused the paper jam is removed by the user, an index sheet having the same format (the same index label position) added instead of the index sheet that has caused the paper jam is set in the sheet feeding unit 41, and an "OK" button 91*a* is pressed on the display screen 91. When the "OK" button 91*a* is pressed, the procedure returns to Step S105. By returning to Step S105, the index sheet having the same format added instead of the index sheet that has caused the paper jam is extracted from the sheet feeding unit 41, and the previously read image data on the manuscript is printed on the index sheet having the same format added instead of the index sheet that has caused the paper jam.

Figure 4C:
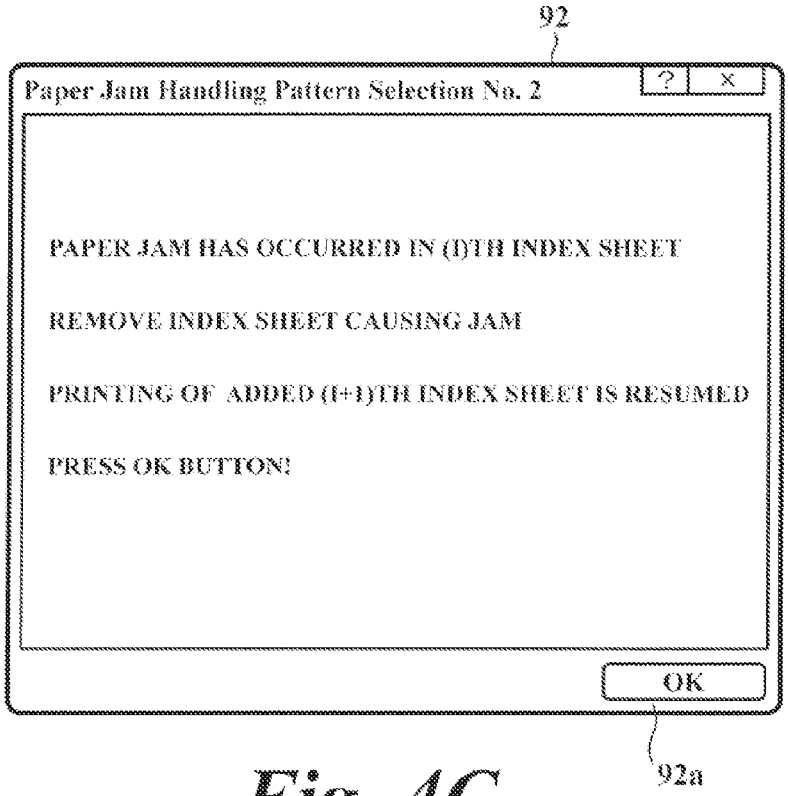

In Step S109, when the paper jam handling pattern No. is "2", the printing processing unit 71 displays a display screen 92 illustrated in FIG. 4C on the liquid crystal display unit 51, and stands by until the index sheet that has caused the paper jam is removed by the user and an "OK" button 92*a* is pressed on the display screen 92. When the "OK" button 92*a* is pressed, the procedure advances to Step S111. By advancing to Step S111, a subsequent manuscript is read, a subsequent index sheet is extracted from the sheet feeding unit 41, and an image of the manuscript subsequently read is printed on the subsequent index sheet.

Figure 4D:
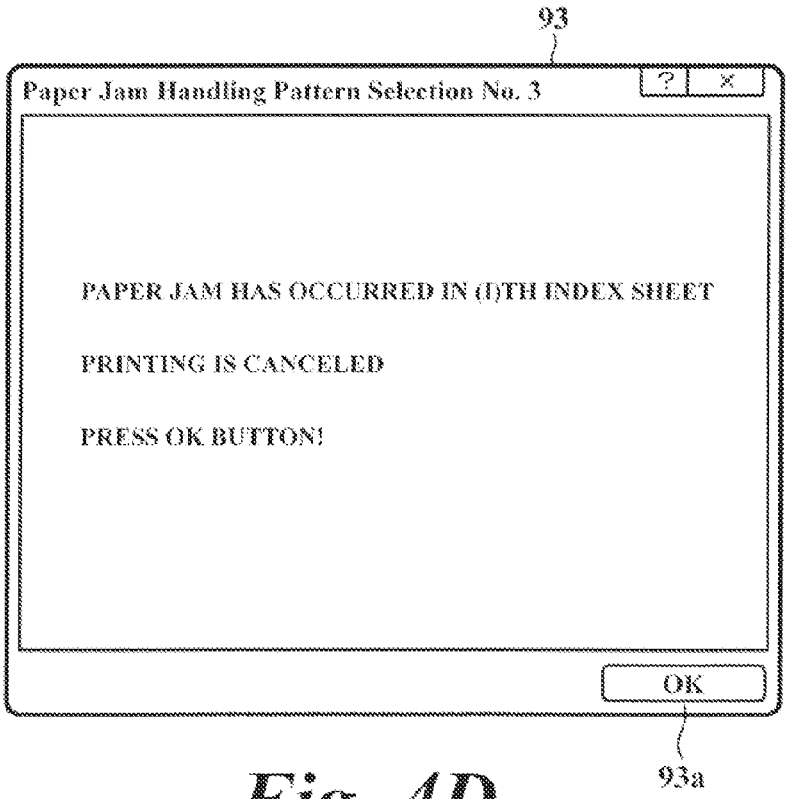

In Step S110, when the paper jam handling pattern No. is "3", the printing processing unit 71 displays a display screen 93 illustrated in FIG. 4D on the liquid crystal display unit 51, and stands by until an "OK" button 93*a* is pressed on the display screen 93. When the "OK" button 93*a* is pressed, the printing process is brought to an end.

In Step S111, in a case of No in Step S106, the printing processing unit 71 adds "1" to the index sheet counter (I), and returns to Step S103.

With the above-mentioned configuration, when a paper jam occurs while the index sheet is being printed, depending on the paper jam handling pattern selected by the user, it is possible to resume from the printing of the index sheet having the same format added instead of the index sheet that has caused the paper jam, to resume from the printing of the subsequent index sheet, or to cancel the printing. In this manner, the paper jam that has occurred can be handled in accordance with the paper jam handling pattern selected by the user before the print start. Therefore, for example, in a situation where an alternative index sheet is at hand, even when a paper jam occurs during the printing after the user selects a paper jam handling pattern "1" to start printing, it is not necessary to print only the index sheet that has caused the paper jam later. Further, in a situation where the alternative index sheet is not at hand, even when a paper jam occurs during the printing after the user selects a paper jam handling pattern "2" to start printing, it is possible to print the index sheets subsequent to the index sheet that has caused the paper jam in accordance with the user's settings. Further, in a situation where, for example, a person who wishes to use the image forming apparatus 1 next is waiting, when the user selects a paper jam handling pattern "3" and presses the "OK" button 92*a*, it is possible to easily cancel the printing of the index sheet. In addition, the index sheet counter (I) for the index sheet that has caused the paper jam is displayed on the paper jam handling pattern "1" display screen 91, the paper jam handling pattern "2" display screen 92, or the paper jam handling pattern "3" display screen 93, and hence the user can easily recognize a position in sequence of the index sheet that has caused the paper jam.

In another embodiment of the present disclosure, a printer driver 102*c* for the image forming apparatus 1 is installed on the client apparatus 11 such as a PC illustrated in FIG. 3.

Figure 6:
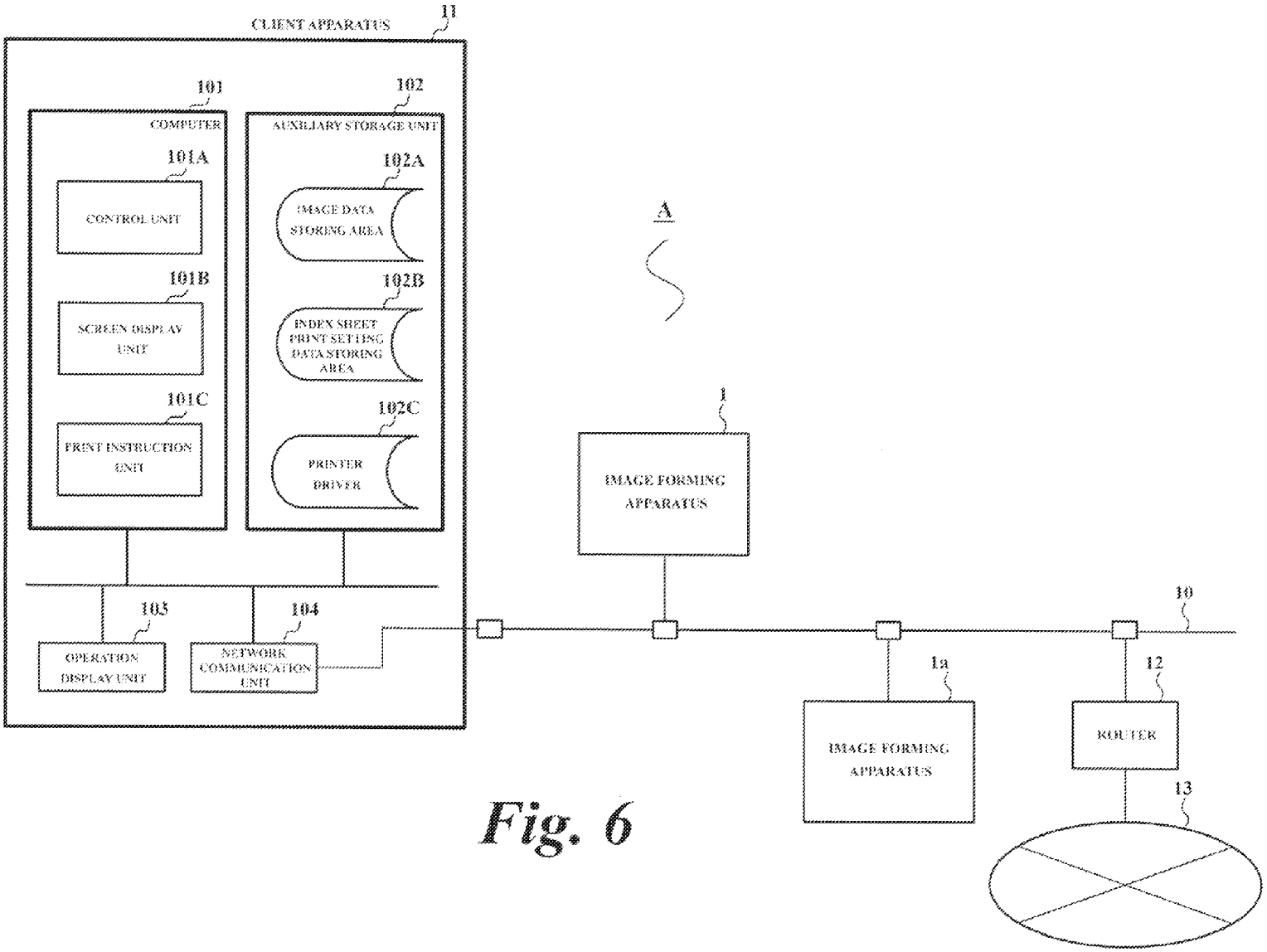
FIG. 6 is a schematic diagram illustrating a functional block configuration of an image forming system according to an embodiment of the present disclosure.

FIG. 6 is a schematic diagram illustrating a functional block configuration of an image forming system A according to an embodiment. The image forming system A includes the image forming apparatus 1, the image forming apparatus 1*a*, the network 10, the client apparatus 11, the router 12, and the Internet 13. The image forming apparatus 1, the image forming apparatus 1*a*, the client apparatus 11, and the router 12 are connected to the network 10, and also may be connected to the Internet 13 via the router 12.

The functional configurations of the image forming apparatus 1 and 1*a* are the same as the functional configurations of the image forming apparatus 1 and 1*a* according to the previous embodiment.

The client apparatus 11 includes a computer 101, an auxiliary storage unit 102, an operation display unit 103, and a network communication unit 104, and those units are connected to one another via a bus or the like.

A control unit 101*a* includes a main memory such as a RAM or a ROM and a control device such as a central processing unit (CPU). Further, the control unit 101*a* performs comprehensive control of the client apparatus 11 including various kinds of I/O, an interface such as a universal serial bus (USB), and a bus controller.

The printer driver 102*c* causes the computer 101 of the client apparatus 11 to function as a screen display unit 101*b* and a print instruction unit 101*c*. The screen display unit 101*b* displays the index sheet setting screen, the index label setting screen, and the paper jam handling pattern selection screen 80 according to the previous embodiment on the operation display unit 103. The print instruction unit 101*c* transmits the image data, and index sheet print setting data set from the index sheet setting screen, the index label setting screen, and the paper jam handling pattern selection screen 80 to the image forming apparatus 1 via the network communication unit 104.

The auxiliary storage unit 102 is an auxiliary storage apparatus formed of a flash memory, and stores the printer driver 102*c* and a program and data for processing to be executed by the computer 101. The auxiliary storage unit 102 includes an image data storing area 102*a* and an index sheet print setting data storing area 102*b*.

The image data storing area 102*a* stores the image data generated by the client apparatus 11, the image data on the manuscript read by the scanner or the like, and other such data.

The index sheet print setting data storing area 102*b* stores the index sheet setting screen, the index label setting screen, the setting data set from the paper jam handling pattern selection screen 80, and other such data.

The operation display unit 103 includes the operation panel, receives an input of the user's operation via the operation panel, and displays a result of the user's operation. Further, the operation display unit 103 displays the index sheet setting screen, the index label setting screen, and the paper jam handling pattern selection screen 80, and receives inputs of the user's settings.

The network communication unit 104 includes a detachably mountable LAN interface for connection to the network 10. The LAN interface includes a network unit that performs intelligent transmission/reception via various network protocols such as TCP/IP, AppleTalk, and SMB.

A description will now be provided of paper jam processing for the printing of the index sheet according to an embodiment. First, the screen display unit 101*b* displays the index sheet setting screen on the operation display unit 103 of the client apparatus 11. The user sets index sheet information including the index label count, the print size, the index label interval, and the index label size. The set index sheet information is stored in the index sheet print setting data storing area 102*b* of the auxiliary storage unit 102. Further, when an image is printed on the index label, the screen display unit 101*b* displays the index label setting screen on the operation display unit 103. The user sets index label information including the image to be printed on the index label, the format of a character when the image includes the character, and the layout thereof. The set index label information is stored in the index sheet print setting data storing area 102*b* of the auxiliary storage unit 102. Further, the screen display unit 101*b* displays the paper jam handling pattern selection screen 80 illustrated in FIG. 4A on the operation display unit 103. The user presses the "OK" button 80*a* after selecting one of the paper jam handling pattern Nos. "1", "2", and "3". The selected handling pattern No. is stored in the index sheet print setting data storing area 102*b* of the auxiliary storage unit 102.

Subsequently, when the user uses the operation display unit 103 to start the printing of the index sheet, the print instruction unit 101*c* instructs the image forming apparatus 1 to perform printing. Note that, the index sheet P is set in the sheet feeding unit 41 of the image forming apparatus 1 in advance.

When printing of the index sheet is started, the control unit 101*a* acquires the image data from the image data storing area 102*a*, and acquires the index sheet print setting data from the index sheet print setting data storing area 102*b*. The print instruction unit 101*c* transmits the image data and the index sheet print setting data that are printing request data, to the image forming apparatus 1 via the network communication unit 104.

Subsequently, in the image forming apparatus 1, when receiving the printing request data, the printing processing unit 71 starts the printing process.

Figure 7:
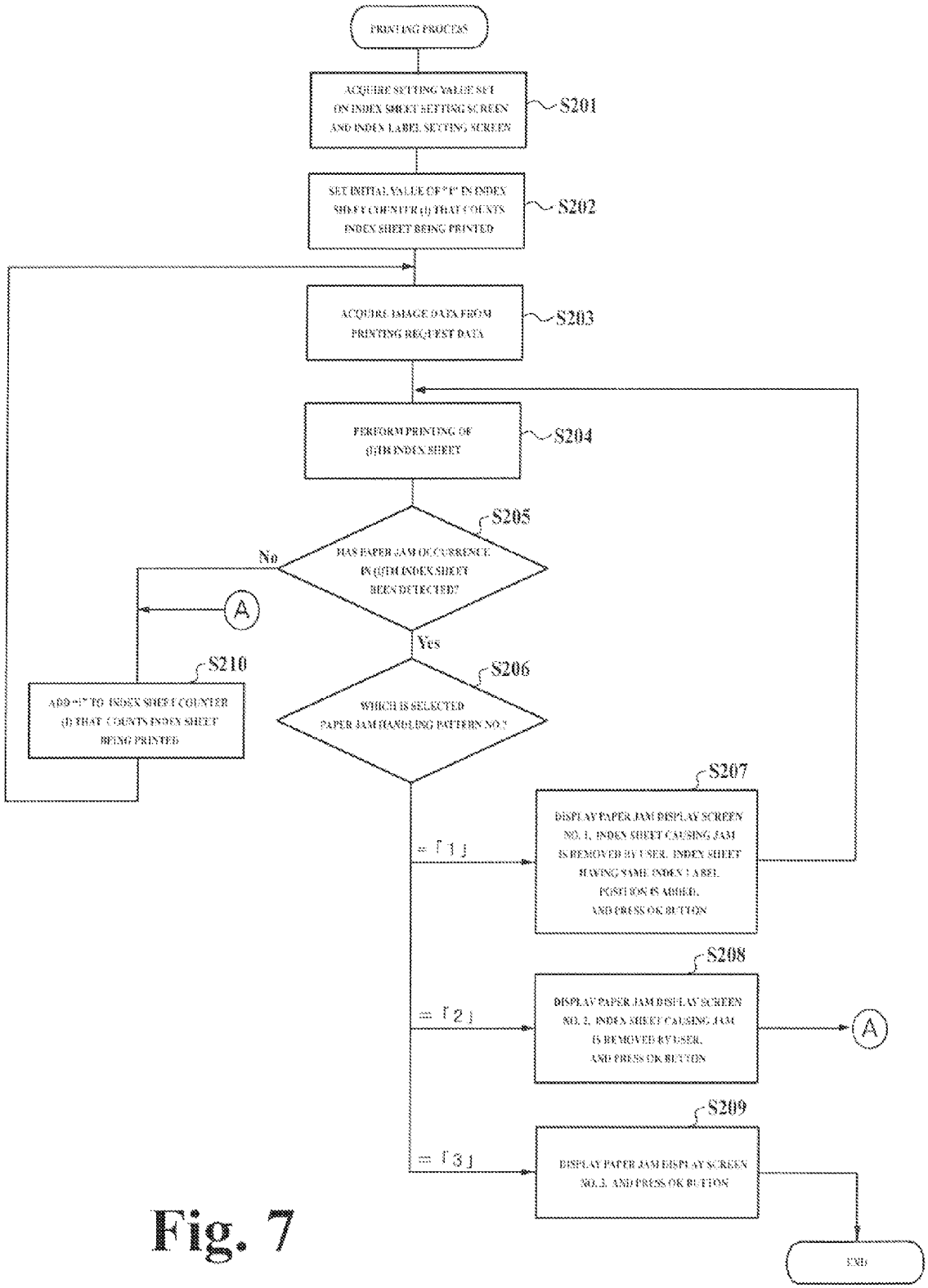
FIG. 7 is a flowchart of printing process for an index sheet according to an embodiment.

FIG. 7 is a flowchart of printing process for an index sheet according to an embodiment.

In Step S201, the printing processing unit 71 acquires the index sheet print setting data stored in the printing request data, and uses the index sheet information and the index label information to set a toner fixing size in the fixing unit 66, a paper sheet interval in the sheet feeding roller 42, and the like.

In Step S202, the printing processing unit 71 sets an initial value of "1" in an index sheet counter (I) that counts index sheets that are being printed.

In Step S203, the printing processing unit 71 acquires the image data from the printing request data. Note that, image data is acquired sequentially in units of pages.

In Step S204, the printing processing unit 71 extracts the (I)th index sheet P from the sheet feeding unit 41, and executes the printing of the index sheet.

In Step S205, the printing processing unit 71 determines whether or not a paper jam occurrence has been detected by the paper jam detection unit 72, to thereby determine whether or not a paper jam has occurred in the (I)th index sheet P. When a paper jam has occurred in the (I)th index sheet P (Yes in Step S205), the procedure advances to Step S206. When a paper jam has not occurred in the (I)th index sheet P (No in Step S205), the procedure advances to Step S210.

In Step S206, in a case of Yes in Step S205, the printing processing unit 71 acquires the paper jam handling pattern No. set on the paper jam handling pattern selection screen 80 and stored in the printing request data. The printing processing unit 71 advances to Step S207 when the paper jam handling pattern No. is "1", advances to Step S208 when the paper jam handling pattern No. is "2", and advances to Step S209 when the paper jam handling pattern No. is "3".

In Step S207, when the paper jam handling pattern No. is "1", the printing processing unit 71 transmits display request data on the display screen 91 illustrated in FIG. 4B to the client apparatus 11. When the client apparatus 11 receives the display request data, the screen display unit 101*b* displays the display screen 91 on the operation display unit 103. The printing processing unit 71 stands by until the index sheet that has caused the paper jam is removed by the user, the index sheet having the same format (the same index label position) added instead of the index sheet that has caused the paper jam is set in the sheet feeding unit 41, and the "OK" button 91*a* is pressed on the display screen 91. When the "OK" (confirmation) button 91*a* is pressed, the print instruction unit 101*c* transmits screen response data on "OK" (confirmation) to the image forming apparatus 1. When receiving the screen response data on "OK", the printing processing unit 71 returns to Step S204. By returning to Step S204, the index sheet having the same format added instead of the index sheet that has caused the paper jam is extracted from the sheet feeding unit 41, and the image data is printed on the index sheet having the same format added instead of the index sheet that has caused the paper jam.

In Step S208, when the paper jam handling pattern No. is "2", the printing processing unit 71 transmits display request data on the display screen 92 illustrated in FIG. 4C to the client apparatus 11. When the client apparatus 11 receives the display request data, the screen display unit 101*b* displays the display screen 92 on the operation display unit 103. The printing processing unit 71 stands by until the index sheet that has caused the paper jam is removed by the user and the "OK" button 92*a* is pressed on the display screen 92. When the "OK" button 92*a* is pressed, the print instruction unit 101*c* transmits screen response data on "OK" to the image forming apparatus 1. When receiving the screen response data on "OK", the printing processing unit 71 advances to Step S210. By advancing to Step S210, subsequent image data is acquired, a subsequent index sheet is extracted from the sheet feeding unit 41, and the subsequent image data is printed on the subsequent index sheet.

In Step S209, when the paper jam handling pattern No. is "3", the printing processing unit 71 transmits display request data on the display screen 93 illustrated in FIG. 4D to the client apparatus 11. When the client apparatus 11 receives the display request data, the screen display unit 101*b* displays the display screen 93 on the operation display unit 103. The printing processing unit 71 stands by until the "OK" button 93*a* is pressed on the display screen 93. When the "OK" button 93*a* is pressed, the print instruction unit 101*c* transmits response data on "OK" to the image forming apparatus 1, and when the printing processing unit 71 receives the response data on "OK", the printing process is brought to an end.

In Step S210, in a case of No in Step S205, the printing processing unit 71 adds "1" to the index sheet counter (I), and returns to Step S203.

Note that, this embodiment is described by taking a situation where the printing request data on the index sheet is transmitted from the client apparatus 11 connected to the network 10 to the image forming apparatus 1 connected to the network 10, but the present disclosure is not limited thereto. For example, the printing request data on the index sheet can be transmitted from the client apparatus 11 connected to the network 10 to the image forming apparatus 1 connected to the Internet 13. Further, the printing request data on the index sheet can be transmitted from the client apparatus 11 connected to the Internet 13 to the image forming apparatus 1 connected to the network 10. Further, the printing request data on the index sheet can be transmitted from the client apparatus 11 connected to the Internet 13 to the image forming apparatus 1 connected to the Internet 13.

As described above, the user can request printing of the index sheet from the client apparatus 11. Further, when a paper jam occurs in the image forming apparatus 1 while the index sheet is being printed, the paper jam handling pattern "1" display screen 91, the paper jam handling pattern "2"

display screen 92, or the paper jam handling pattern "3" display screen 93 is displayed on the operation display unit 103 of the client apparatus 11, to thereby allow the user to handle the paper jam from the client apparatus 11.

Note that, in the paper jam handling pattern No. "3", as illustrated in FIG. 4D, the "OK" button 93*a* is provided to the paper jam handling pattern "3" display screen 93, and the printing process is brought to an end when the user sets the "OK" button 93*a*. However, instead of providing the "OK" button 93*a*, the printing process can be brought to an end after the paper jam handling pattern "3" display screen 93 is displayed.

FIG. 2 also illustrates that one sheet feeding cassette is placed in the sheet feeding unit 41. This is merely an example, and a plurality of sheet feeding cassettes different in paper size can be placed in the sheet feeding unit 41.

The image forming apparatus according to an embodiment of the present disclosure prevents wasteful printing due to deviation in sheet feeding when a paper jam occurs in the printing of the index sheet. Further, it is possible to provide an easy-to-use image forming apparatus by allowing the user to select a pattern of handling the paper jam.

It should be understood that various changes and modifications to the embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. An image forming system comprising:

an image forming apparatus connected to a network, and a client apparatus connected to the network, the image forming apparatus comprising:

a printing processing unit configured to print on a plurality of index sheets having index labels in different positions;

a paper jam detection unit configured to detect a paper jam in the plurality of index sheets; and the client apparatus comprising:

an operation display unit configured to display, when the paper jam is detected, a paper jam handling pattern selection screen for selecting a paper jam handling pattern of the printing processing unit, wherein the paper jam handling pattern includes:

a first paper jam handling pattern to resume from the printing of an added index sheet having the same index label position as the index label position of an index sheet that has caused the paper jam;

a second paper jam handling pattern to resume from the printing of an index sheet subsequent to the index sheet that has caused the paper jam; and a third paper jam handling pattern to cancel the printing.

2. The image forming system according to claim 1, wherein the operation display unit is configured to display an index sheet setting screen and an index label setting screen.

3. The image forming system according to claim 2, wherein a print instruction unit is configured to transmit printing request data to the image forming apparatus, the printing request data including index sheet information from the index sheet setting screen, index label information from the index label setting screen, and the paper jam handling pattern from the paper jam handling pattern selection screen.

4. The image forming system according to claim 3, wherein the printing processing unit is configured to transmit to the client apparatus, when the paper jam detection unit detects a paper jam occurrence, display request data on a display screen corresponding to the paper jam handling pattern included in the printing request data.

5. The image forming system according to claim 4, wherein the operation display unit is configured to display, when the client apparatus receives the display request data, the display screen corresponding to the paper jam handling pattern, and the print instruction unit is configured to transmit to the image forming apparatus, when a confirmation button displayed on the display screen corresponding to the paper jam handling pattern is pressed, screen response data on confirmation.

6. The image forming system according to claim 5, wherein the printing processing unit is configured to perform, when receiving the screen response data, printing process corresponding to the paper jam handling pattern included in the printing request data.

7. The image forming system according to claim 1, wherein the operation display unit is configured to display a position in sequence of the index sheet that has caused the paper jam.

8. A non-transitory computer-readable recording medium including a printer driver, the printer driver causing a computer of a client apparatus to function as:

a print instruction unit configured to instruct an image forming apparatus connected to the client apparatus via a network to perform printing, wherein the image forming apparatus includes:

a printing processing unit configured to print on a plurality of index sheets having index labels in different positions; and a paper jam detection unit configured to detect a paper jam in the plurality of index sheets; and a screen display unit configured to display a paper jam handling pattern selection screen for selecting a paper jam handling pattern of the printing processing unit, on an operation display unit of the client apparatus, wherein the paper jam handling pattern includes:

a first paper jam handling pattern to resume from the printing of an added index sheet having the same index label position as the index label position of an index sheet that has caused the paper jam;

a second paper jam handling pattern to resume from the printing of an index sheet subsequent to the index sheet that has caused the paper jam; and a third paper jam handling pattern to cancel the printing.

9. The non-transitory computer-readable recording medium according to claim 8, wherein the screen display unit is configured to display an index sheet setting screen and an index label setting screen on the operation display unit.

10. The non-transitory computer-readable recording medium according to claim 9, wherein the print instruction unit is configured to transmit printing request data to the image forming apparatus, the printing request data comprising index sheet information from the index sheet setting screen, index label information from the index label setting screen, and the paper jam handling pattern from the paper jam handling pattern selection screen.

11. The non-transitory computer-readable recording medium according to claim 10, wherein the client apparatus is configured to receive from the printing processing unit, when the paper jam detection unit detects a paper jam occurrence, display request data on a display screen corresponding to the paper jam handling pattern included in the printing request data.

12. The non-transitory computer-readable recording medium according to claim 11, wherein the screen display unit is configured to display, when the client apparatus receives the display request data, the display screen corresponding to the paper jam handling pattern on the operation display unit; and the print instruction unit is configured to transmit to the image forming apparatus, when a confirmation button displayed on the display screen corresponding to the paper jam handling pattern is pressed, screen response data on confirmation.

13. The non-transitory computer-readable recording medium according to claim 8, wherein the screen display unit is configured to display a position in sequence of the index sheet that has caused the paper jam on the operation display unit.

* * * * *